US006497099B2

(12) United States Patent
Junk

(10) Patent No.: US 6,497,099 B2
(45) Date of Patent: Dec. 24, 2002

(54) METHOD AND DEVICE FOR CONTROLLING A STEAM TURBINE WITH A STEAM BLEED

(75) Inventor: Rainer Junk, Grossenseebach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/968,429

(22) Filed: Oct. 1, 2001

(65) Prior Publication Data

US 2002/0066271 A1 Jun. 6, 2002

Related U.S. Application Data

(63) Continuation of application No. PCT/DE00/00904, filed on Mar. 24, 2000.

(30) Foreign Application Priority Data

Mar. 31, 1999 (DE) ..... 199 14 626

(51) Int. Cl.[7] ..... F01K 7/22
(52) U.S. Cl. ..... 60/679; 60/653; 60/677
(58) Field of Search ..... 60/645, 653, 670, 60/677, 679

(56) References Cited

U.S. PATENT DOCUMENTS 3,724,214 A 4/1973 Bryant
4,007,595 A * 2/1977 Braytenbah et al. ..... 60/644
4,053,786 A * 10/1977 Jones et al. ..... 290/52
4,056,331 A 11/1977 Sato
4,146,270 A 3/1979 Nurnberger et al.
4,357,803 A * 11/1982 Dickenson ..... 60/662
5,038,568 A * 8/1991 Gounder et al. ..... 60/679

FOREIGN PATENT DOCUMENTS

EP 0 704 777 A1 4/1996

OTHER PUBLICATIONS

XP–002144200, 1972, pp. 53–75.
Rainer Hampel et al.: "Dampfturbinenregelung mit Fuzzy–Logik" [Steam turbine control with fuzzy logic] 8130 ATP Automatisierungstechnische Praxis 37 (Jun. 1995), No. 6, Muenchen, Germany, pp. 32–41.

* cited by examiner

*Primary Examiner*—Hoang Nguyen
(74) *Attorney, Agent, or Firm*—Laurence A. Greenberg; Werner H. Stemer; Ralph E. Locher

(57) ABSTRACT

A method for controlling a steam turbine with a steam bleed for various operational tasks is provided. The operational tasks are each characterized by the type of the controlled variables used for controlling the steam turbine. A control structure is used for deriving actuating signals for actuating elements for valves. The actuating signals are derived from control signals of the regulators which are used. Only a single control structure is used for all the operational tasks. As a result, the configuration of the control is simplified, the control signals are decoupled, and a smooth changeover between the operational tasks is achieved. A device for controlling a steam turbine is also provided.

6 Claims, 8 Drawing Sheets

METHOD AND DEVICE FOR CONTROLLING A STEAM TURBINE WITH A STEAM BLEED

CROSS-REFERENCE TO RELATED APPLICATION

This application is a continuation of copending International Application No. PCT/DE00/00904, filed Mar. 24, 2000, which designated the United States.

BACKGROUND OF THE INVENTION

Field of the Invention

The invention relates to a method for controlling a steam turbine with a steam bleed. The invention also relates to a control device for such a steam turbine.

A control of a steam turbine with bleed steam, called a bleeder turbine for short, is described in the book having the title "Regelung von Dampfturbinen" ["Closed-loop control of steam turbines"] by Adolf Brücher, 2nd edition, 1972, Kraftwerkunion AG, Mülheim/Ruhr, from page 53 in the Chapter "Reglereinstellblatt bei gesteuerten Entnahmeturbinen" ["Regulator adjustment sheet for controlled bleeder turbines"]. In the case of a bleeder turbine, steam for normal operational purposes is bled off from a specific stage. If steam is bled off to condensation or feed-water preheaters, only one connection is provided from the stage to these preheaters, without any closed-loop control element. This is a so-called uncontrolled bleeding or tapping. The pressure at a tap is governed by the flow rate or amount of the steam passing through the turbine.

In contrast to this, it may be necessary to provide steam at a specific pressure, irrespective of the magnitude of the turbine steam flow rate, and thus the electrical power. However, this requirement can be satisfied only if it is possible to maintain pressure. In this case, the steam turbine is a controlled bleeder turbine. For example, steam flows into the high-pressure section of such a bleeder turbine. At the end of the high-pressure section, the steam flows on the one hand into a steam bleed line, and on the other hand into a low-pressure section of the turbine. The steam which flows through the low-pressure section can then be supplied not only to a condenser but also, once again, to a bleed line. The latter configuration is referred to as a backpressure bleeder turbine. Thus, the function of a bleeder turbine is not only to drive a generator, but also to provide so-called process steam for operational purposes.

Depending on the desired amount of electrical power or the desired amount of process steam, different operational tasks arise with regard to the closed-loop control of the bleeder turbine. These tasks are characterized by different types of controlled variables that are used for closed-loop control. The controlled variables may be, for example, a bleed steam flow rate, a power level emitted from the turbine, a rotation speed of the turbine shaft, a backpressure in the steam flowing out of the turbine, or an initial pressure in the steam flowing into the turbine. One operational task would thus be characterized, for example, by closed-loop control on the basis of the bleed steam flow rate and the power. Another operational task would be characterized, for example, by closed-loop control on the basis of the bleed steam flow rate and the backpressure.

U.S. Pat. No. 4,146,270 discloses a control device for a steam turbine with speed and power control coupled on the output side. A fuzzy controller described in the article "Dampfturbinenregelung mit Fuzzy-Logik" [steam turbine regulation with fuzzy logic], R. Hampel, N. Chaker, in ATP Automatisierungstechnische Praxis [automation engineering in practice], 37 (1995), June, No. 6, Munich, Germany, is intended to permit such regulation in the case of a steam turbine with steam bypass stations. Nevertheless, until now, a specific control structure has been used for each operational task. Parameters obtained empirically are in this case linked so that the desired control response is obtained for the operational task. Both the parameters and the linking of the parameters thus differ from one another, so that use is always made of different control structures.

SUMMARY OF THE INVENTION

It is accordingly an object of the invention to provide a method for controlling a steam turbine with a steam bleed which overcomes the above-mentioned disadvantages of the heretofore-known methods of this general type and which is matched in a simple and operationally reliable manner to the operational tasks of the steam turbine. It is a further object of the invention to provide a control device for a steam turbine with a steam bleed that carries out the operational tasks of the steam turbine in a simple and operationally reliable manner.

With the foregoing and other objects in view there is provided, in accordance with the invention, a method for controlling a steam turbine, the method includes the steps of:

regulating a steam feed via a feed valve, and regulating a steam bleed via a bleed valve;

supplying, with a first regulator or a second regulator, a first control signal and a second control signal to a regulating structure as a function of controlled variables fed to the first regulator or the second regulator;

linking, when there is a task-specific change between the first and second regulators, by using always a same regulating structure including a parameter set subdivided into subgroups, each subgroup having a first parameter and a second parameter, a result of a conversion of the first control signal with the second parameter and a result of a conversion of the second control signal with the first parameters to one another;

determining a first actuating signal with a first one of the subgroups and determining a second actuating signal with a second one of the subgroups; and feeding the first actuating signal to the feed valve and feeding the second actuating signal to the bleed valve.

In other words, a method for controlling a steam turbine is provided in which a steam feed is regulated via a feed valve and a steam bleed is regulated via a bleed valve, wherein a first regulator or a second regulator emits a first control signal and a second control signal to a regulating structure as a function of the controlled variables respectively fed to them, wherein, during a task-specific change between the regulators by using a regulating structure which is always the same and has a parameter set subdivided into subgroups each having a first parameter and a second parameter, within each subgroup, the result of a conversion of the first control signal using the second parameter and the result of a conversion of the second closed-loop control signal using the first parameters are linked to each other, and wherein a first actuating signal fed to the feed valve is determined with a first subgroup, and a second actuating signal fed to the bleed valve is determined with a second subgroup.

There may also be a plurality of feed valves or else a plurality of bleed valves, and corresponding regulators. A bleed valve may also at the same time be a feed valve. For example, a steam bleed from a first stage of the steam turbine may be controlled by adjusting a feed steam quantity or flow rate (feed flow rate for short) for a second stage in the steam turbine, following the first stage, such that the desired bleed steam quantity or flow rate (bleed flow rate for short) is obtained from the difference between the respective feed flow rate supplied to the first stage and that supplied to the second stage.

A steam feed or else a steam bleed may be supplied to or taken from any point on the steam turbine, depending on the requirement. The operational tasks are characterized by the nature of the controlled variables, depending on the desired emission of power from the turbine or the desired bleed steam flow rate. For example, one operational task is characterized by a (closed-loop) control based on the steam bleed flow rate the rotational speed of the turbine.

The control structure is used to convert the control signals from the regulators into actuating signals for actuating elements for the feed or bleed valve. Depending on the operational task, this conversion must be carried out in a manner matched to the operational task, since each operational task is based on a different operating envelope for the feed or bleed valve.

In the invention only a single control structure is now used for this purpose for all the operational tasks. In this case, each operational task is now in each case characterized only by a specific set of parameters for the common control structure. The entire control system for the steam turbine is thus simplified. Furthermore, a high level of operational reliability is ensured since a smooth changeover can be carried out by the same control structure, in particular when changing from a first to a second operational task. This means that there is no sudden change to the actuated actuating element when changing from a first regulator to a second regulator. Such a sudden change in an actuating element position, which until now could not be ensured, since different control structures were used for the various tasks, results in a high mechanical load on this actuating element.

The common control structure for all the operational tasks means that it is possible to ensure that the controlled variables are largely decoupled from one another. This means that, for example, there is no significant change in power from the steam turbine when a change is made to the bleed steam flow rate. The desired parameters can thus be set independently of one another, depending on the operational requirement. With a control with different regulator structures for each operational task by empirically obtained parameters, such decoupling over the entire operating envelope is virtually impossible, due to the large number of parameters. In contrast, with the common control structure, the control structure parameters for the respective operational task are defined in a simple manner, using coupling functions between the controlled variables, such that the controlled variables are decoupled from one another. The parameters are preferably furthermore defined such that an operating envelope is defined which is matched to the chosen operational task.

One of the controlled variables is preferably a bleed steam amount or flow rate, a pressure in the steam turbine, a power level of the steam turbine, or a rotational speed of the steam turbine.

Each operational task is assigned a parameter group, which characterizes it, for the control structure. When a change is made from a first of the operational tasks to a second of the operational tasks, a change takes place from a first regulator to a second regulator such that initial variables for the output of the second regulator are fixed through the use of an inverse closed-loop control structure. The inverse closed-loop control structure is in this case the inverse of the closed-loop control structure with the parameter group for the second operational task. The initial variables are supplied to the second regulator. The second regulator thus starts with values which correspond to the last actuation of the first regulator from the old operational task. This means that there is no sudden change to the actuation of the actuating element. The initial variables for the second regulator are defined in a simple manner by using the common control structure in such a way that the initial variables are recalculated through the use of the inverse control structure from the actuating variables of the first regulator. The inverse control structure corresponds to reverse calculation of the control structure, with the control structure parameters being used as the basis for the new operational task. A smooth changeover between operational tasks is thus achieved in a simple manner.

Each parameter group preferably includes a feed valve subgroup and a bleed valve subgroup, in which case a first one of the control signals is linked to a first parameter, and a second one of the control signals is linked to a second parameter of each of these subgroups, and in which case the feed valve manipulated variable and the bleed valve manipulated variable, respectively, are additionally determined through the use of a respective offset parameter associated with each subgroup.

With the objects of the invention in view there is also provided, a control device for a steam turbine, including:

two regulators;

the two regulators receiving respective controlled variables and the two regulators respectively outputting, as a function of the controlled variables a first control signal and a second control signal;

a regulating structure receiving the first control signal and the second control signal, the regulating structure being a same regulating structure for the two regulators; and the regulating structure including a parameter set subdivided into subgroups, each of the subgroups having a first parameter and a second parameter, the regulating structure linking a result of a conversion of the first control signal with the second parameter and a result of a conversion of the second control signal with the first parameters to one another such that a first one of the subgroups generates a first actuating signal for a feed valve, and a second one of the subgroups generates a second actuating signal for a bleed valve.

In other words, a control device for a steam turbine with two regulators which, as a function of controlled variables fed to them in each case, emit a first control signal and a second control signal to a control structure that is the same in both regulators, wherein the control structure having a parameter set subdivided into subgroups, each having a first parameter and a second parameter within each subgroup, links the result of a conversion of the first control signal with the second parameter and the result of a conversion of the second control signal with the first parameters to one another, and wherein a first subgroup generates a first actuating signal for the feed valve, and a second subgroup generates a second actuating signal for the bleed valve.

Other features which are considered as characteristic for the invention are set forth in the appended claims.

Although the invention is illustrated and described herein as embodied in a method and device for closed-loop control of a steam turbine with a steam bleed, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
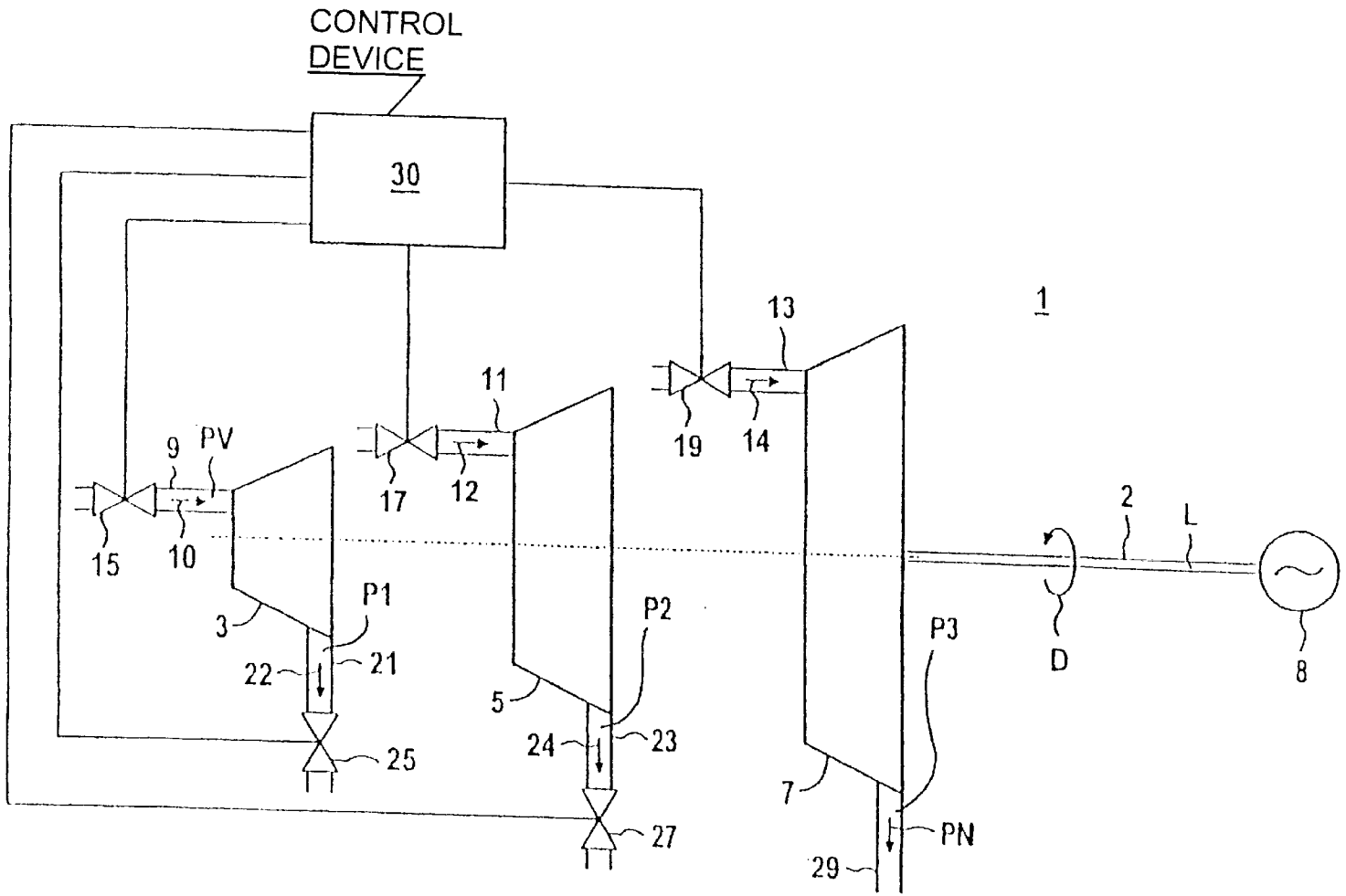
FIG. 1 is a schematic diagram of a steam turbine.

Referring now to the figures of the drawings in detail in which the same reference symbols have the same meaning in the various figures and referring first, particularly, to FIG. 1 thereof, there is schematically shown a steam turbine 1. A high-pressure section 3, a medium-pressure section 5 and a low-pressure section 7 are provided one behind the other on a steam turbine shaft 2. The steam turbine 1 is connected via the steam turbine shaft 2 to a generator 8 for producing electrical power. The high-pressure section 3 has a steam feed 9. The medium-pressure section 5 has a steam feed 11. The low-pressure section 7 has a steam feed 13. Steam feed flow rates 10, 12, 14 flowing into the steam feeds 9, 11, 13 can be adjusted via respective feed valves 15, 17, 19. The high-pressure section 3 also has a steam bleed 21, via which a bleed flow rate 22 flows and can be adjusted through the use of a bleed valve 25. The medium-pressure section 5 has a steam bleed 23, through which a bleed flow rate 24 flows and can be adjusted through the use of a bleed valve 27. The low-pressure section 7 has a steam bleed 29. The feed valves 15, 17, 19 and the bleed valves 25, 27 are connected to a closed-loop control device 30.

When the steam turbine 1 is in operation, steam flows from a steam generator, which is not shown, via the steam feed 9 into the high-pressure section 3, controlled via the feed valve 15. From the high-pressure section 3, steam flows on the one hand via the steam bleed 21, controlled via the bleed valve 25, and on the other hand via the steam feed 11, controlled via the feed valve 17, back to the medium-pressure section 5. The medium-pressure section 5 may also have a steam feed that is separate from the high-pressure section 3, that is to say, for example, process steam being fed in once again. Steam flows from the medium-pressure section 5, controlled via the bleed valve 25, out via the steam bleed 23 and/or flows via the steam feed 13, controlled via the feed valve 19, into the low-pressure section 7.

The bleed valves 25, 27 may also be combined with the feed valves 17, 19. In this case, the bleed steam flow rates 22, 24 are controlled indirectly via the feed steam flow rates 12, 14.

Steam flows out of the low-pressure section 7 via the steam bleed 29. It may be supplied, for example, to a condenser (not shown) or else may be supplied as steam from the steam bleeds 21, 23 for operational purposes.

The steam flowing through the steam turbine 1 causes the steam turbine shaft 2 to rotate at a rotation speed D. The steam turbine 1 emits a power level L to the electrical generator 8 in order to produce electrical power. Before entering the steam turbine 1, that is to say, for example, in the steam feed 9, the steam is at a pressure PV. Downstream from the high-pressure section 3 the steam is at a pressure P1. Downstream from the medium-pressure section 5 the steam is at a pressure P2. Downstream from the low-pressure section 7 the steam is at a pressure P3. The pressures P1, P2, P3 may also, if required, be measured at another, suitable point in the respective turbine sections 3, 5, 7. Downstream from the steam turbine 1, the pressure is PN. The pressures PV, P1, P2, P3, PN may be used as controlled variables for closed-loop control of the steam turbine 1. Other controlled variables may be, for example, the rotation speed D or the power level L. Further controlled variables may be, for example, the bleed steam flow rates 22, 24. Depending on the operational requirements for the steam turbine 1, different bleed steam flow rates 22, 24 or different power levels L, for example, can be set. Accordingly, different controlled variables may be used, depending on the operational requirements, for closed-loop control of the steam turbine 1. The use of the controlled variables characterizes an operational task of the steam turbine 1. This will be explained in more detail further below.

Figure 2:
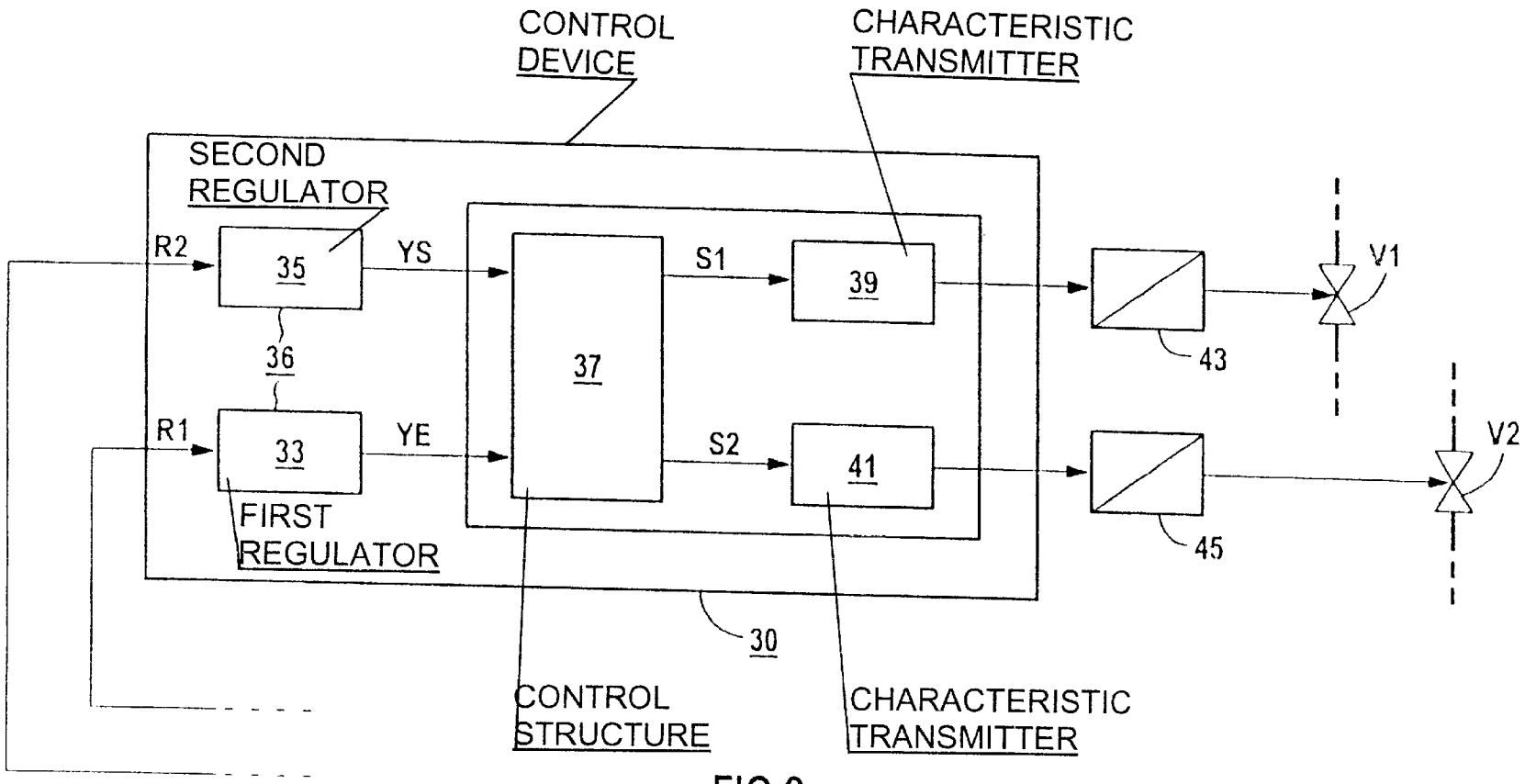
FIG. 2 is a block diagram of a closed-loop control device for a steam turbine according to the invention.

FIG. 2 shows, schematically, a closed-loop control device 30. The closed-loop control device 30 has a first regulator 33 and a second regulator 35, which together form a pair of regulators 36. The first regulator 33 and the second regulator 35 are each connected to a common closed-loop control structure 37. The closed-loop control structure 37 is connected to a first characteristic transmitter 39, and to a second characteristic transmitter 41. The first characteristic transmitter 39 is connected to an actuating element 43. The second characteristic transmitter 41 is connected to a second actuating element 45. The first actuating element 43 is used to operate a first valve V1. The second actuating element 45 is used to operate a second valve V2. The valves V1, V2 may each be, for example, a feed valve 15, 17, 19 or a bleed valve 25, 27 for steam.

A first controlled variable R1 is supplied to the first regulator 33. A second controlled variable R2 is supplied to the second regulator 35. The first regulator 33 passes a first closed-loop control signal YE to the closed-loop control structure 37. The second regulator 35 passes a second closed-loop control signal YS to the closed-loop control structure 37. Depending on the particular operational task at the time, a first actuating signal Si is emitted from the closed-loop control structure 37 to the first characteristic transmitter 39, and a second actuating signal S2 is emitted from the closed-loop control structure 37 to the second characteristic transmitter 41. The characteristic transmitters 39, 41 drive their respectively associated actuating elements 43, 45 so that the valves V1, V2 are adjusted for the closed-loop control task.

Figure 3:
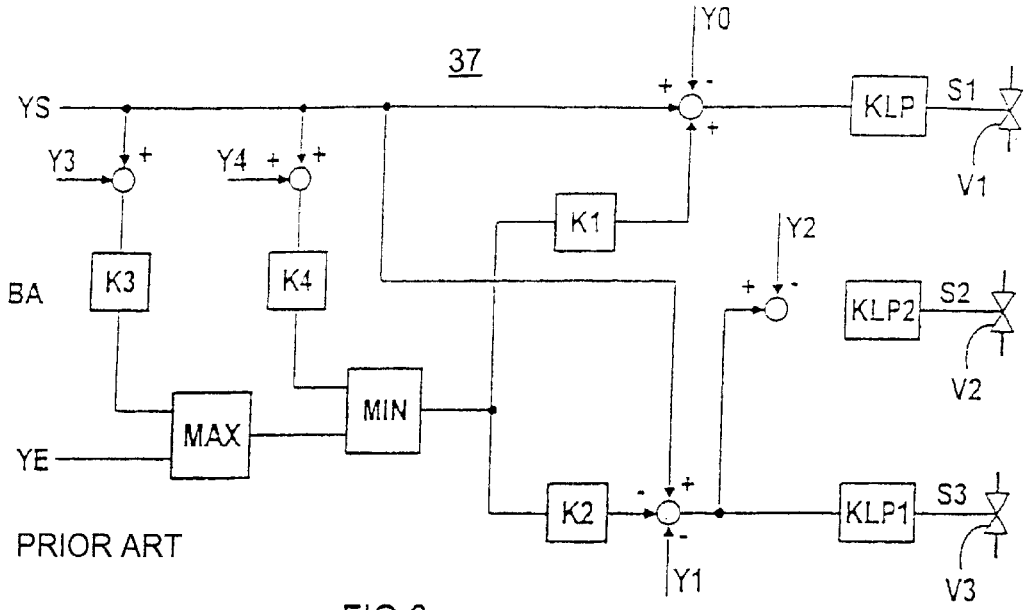
FIGS. 3–5 are block diagrams of closed-loop control structures for various operational tasks for a steam bleeder turbine according to the prior art.
Figure 4:
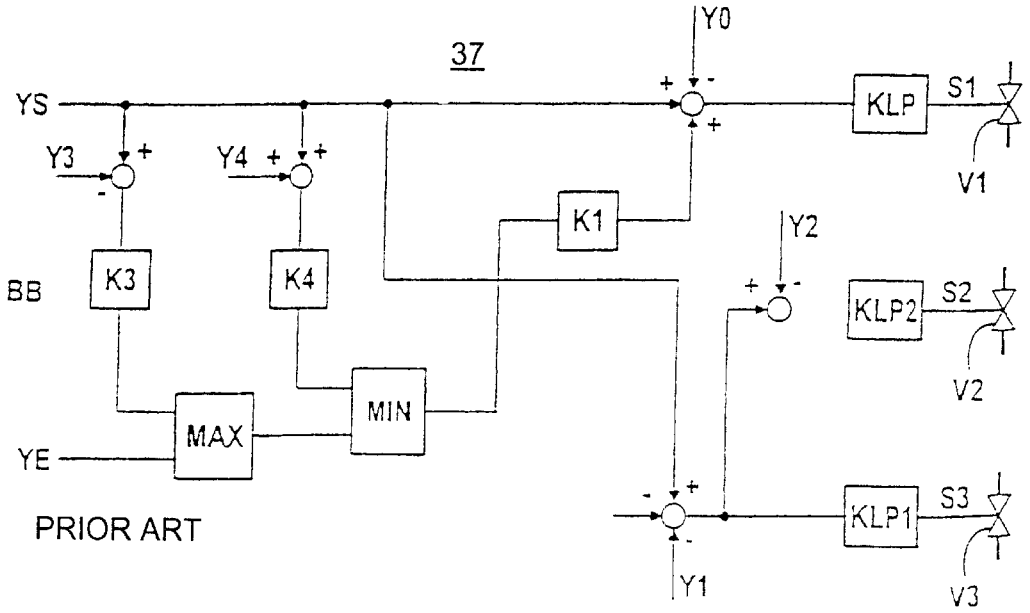
Figure 5:
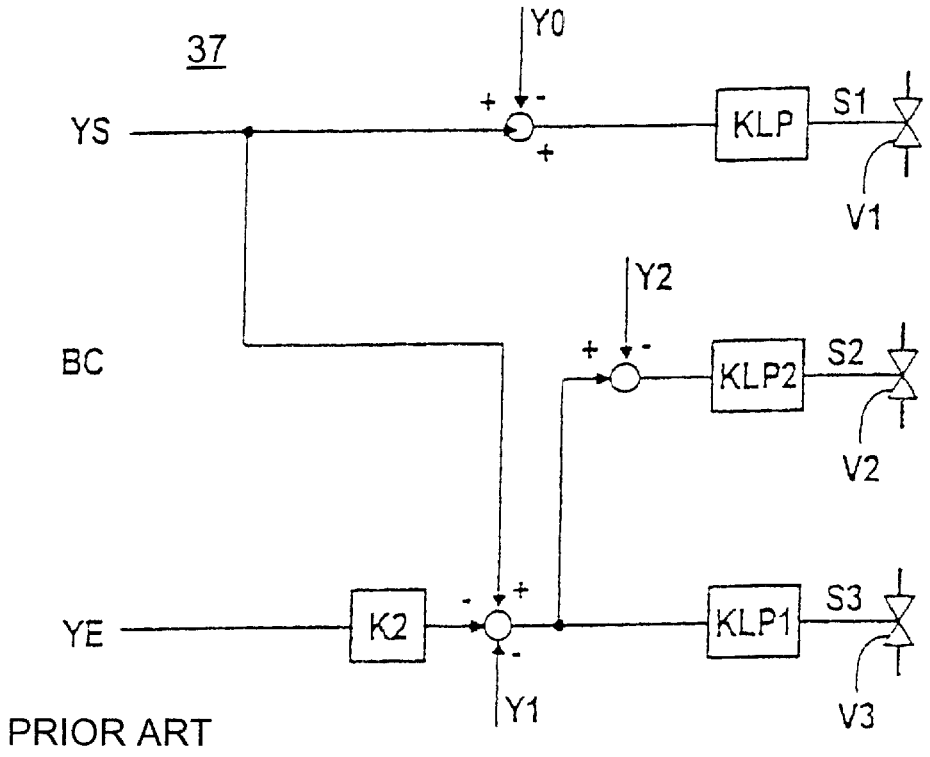

FIGS. 3 to 5 show embodiments of closed-loop control structures 37 according to the prior art. In FIG. 3, based on a first operational task BA, a first closed-loop control signal YE is linked to a second closed-loop control signal YS using empirically obtained parameters K1, K2, K3, K4, Y1, Y2, Y3, Y4, KLP, KLP2, KLP1, so that actuating signals S1, S2, S3 are emitted in order to actuate the valves V1, V2, V3 in a suitable manner. FIGS. 4 and 5 show links between the closed-loop control signals YE, YS for a respectively different operational task BB, BC. The complex links using a large number of parameters are complex to define. It is virtually impossible to decouple the closed-loop control signals YE, YS over the entire operating envelope. Furthermore, it is impossible to ensure that there is no sudden change in the actuation of the actuating elements when changing from a first of the operational tasks BA, BB, BC to a second of the operational tasks BA, BB, BC. This is due to the fact that each closed-loop control structure 37 produces actuating signals S1, S2, S3 independently so that, when changing between the closed-loop control structures 37, that is to say when changing the operational task BA, BB, BC, the actuating signals S1, S2, S3 are generally different, thus causing a sudden change in the actuation of the actuating elements for the valves V1, V2, V3. This can result in severe mechanical loads, and to damage in the long term.

Figure 6:
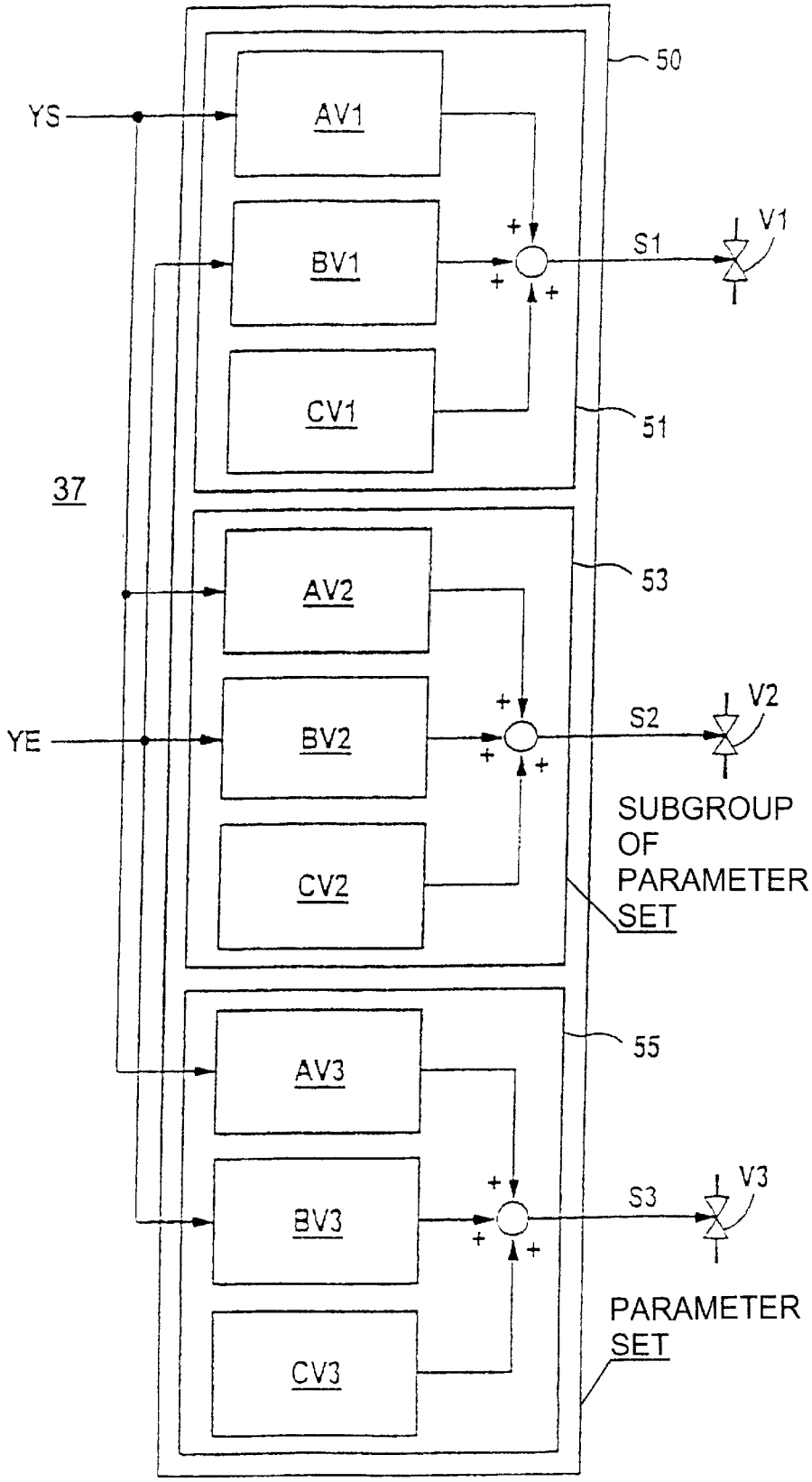
FIG. 6 is a block diagram of a common closed-loop control structure according to the invention configured for all the operational tasks of a steam bleeder turbine.

FIG. 6 shows a closed-loop control structure 37 which can be used for all the operational tasks, for example as shown in FIGS. 3 to 5. The closed-loop control structure 37 includes a parameter set 50. The parameter set 50 is subdivided into subgroups 51, 53, 55. For example, the subgroup 51 is a feed valve subgroup, and the subgroup 53 is a bleed valve subgroup. Each subgroup 51, 53, 55 includes a first parameter AV1, AV2, AV3 and a second parameter BV1, BV2, BV3. Furthermore, each subgroup 51, 53, 55 respectively includes an offset parameter CV1, CV2, CV3. The first closed-loop control signal YE is converted with the aid of the second parameters BV1, BV2, BV3. The second closed-loop control signal YS is converted with the aid of the first parameters AV1, AV2, AV3. These conversions are carried out in each of the subgroups 51, 53, 55. The results of each of the conversion operations are linked to one another within the subgroup 51, 53, 55, with the respective offset parameters CV1, CV2, CV3 being added. An actuating signal S1, S2, S3 is determined from this linking process with each of the subgroups 51, 53, 55. The parameter set 50 is matched to the present operational task, and is defined so that, on the one hand, the controlled variables R1, R2 are decoupled and, on the other hand, the operating envelopes for the operational task are defined.

Figure 7:
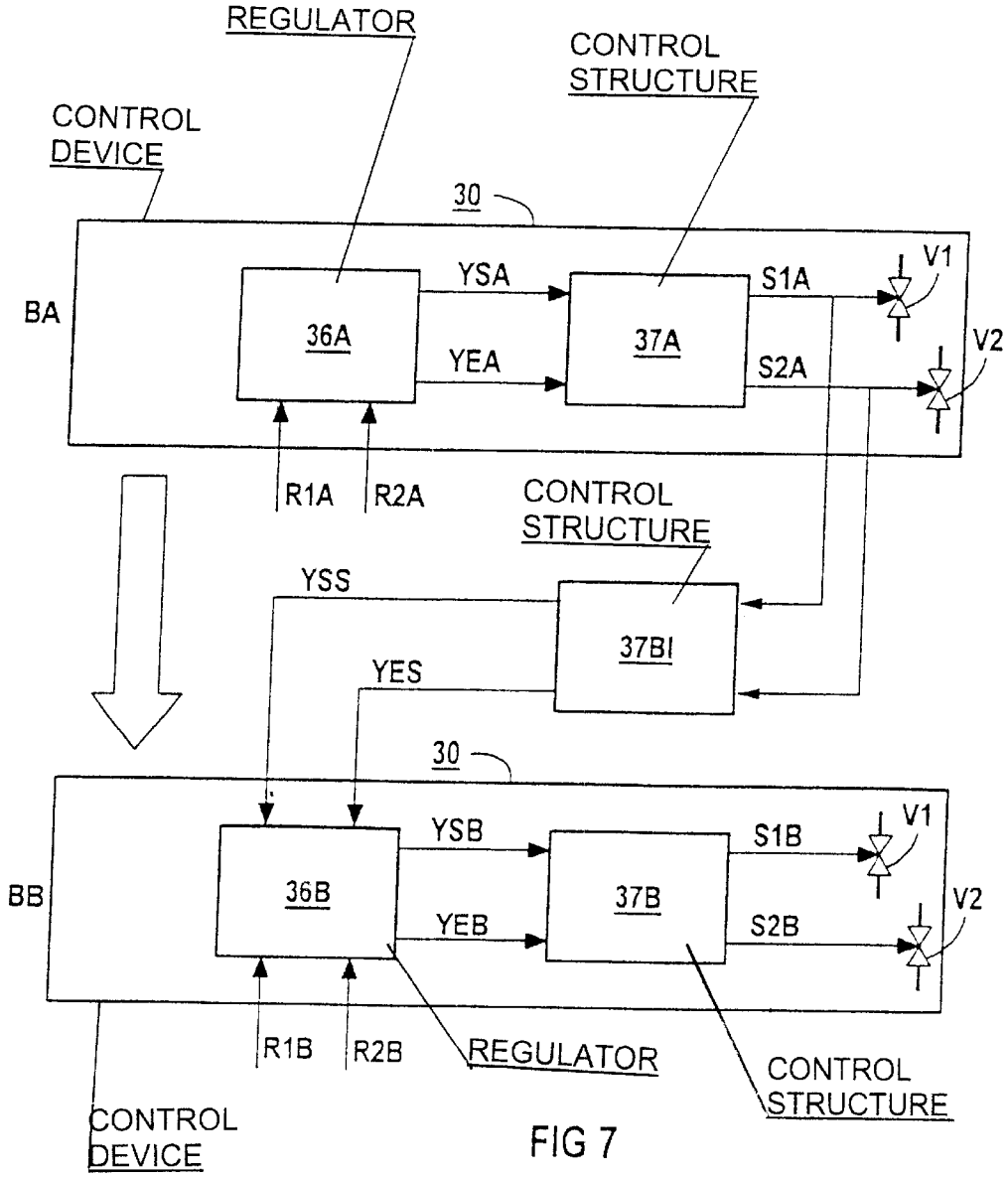
FIG. 7 is a block diagram of a control structure illustrating a change from a first operational task to a second operational task in a steam bleeder turbine.

FIG. 7 shows, schematically, a change from a first operational task BA to a second operational task BB. In the first operational task BA, the closed-loop control signals YEA and YSA, which are converted through the use of the closed-loop control structure 37A into actuating signals S1A, S2A for valves V1, V2, are produced in the illustrated manner via the pair of regulators 36A from the controlled variables R1A and R2A. The same closed-loop control structure 37 is used with a new parameter set 50 for changing to the operational task BB. In FIG. 7, this is denoted by the closed-loop control structure 37B.

The controlled variables RiB and R2B are supplied to the pair of regulators 36B in the operational task BB. The closed-loop control signals YEB and YSB are transmitted from the pair of regulators 36B to the closed-loop control structure 37B. The actuating signals S1B and S2B are derived therefrom, from the closed-loop control structure 37B.

A smooth changeover between the operational tasks BA, BB is achieved in that the actuating signals S1A, S2A from the operational task BA are converted through the use of an inverse closed-loop control structure 37BI into initial signals YES and YSS. The initial signals YES and YSS are supplied as initial values to the pair of regulators 36B for the new operational task BB, so that actuation in the operational task BB starts with actuating signals S1B and S2B, which correspond to the last values of the actuating signals S1A and S2A from the operational task BA. The actuating elements are thus not suddenly actuated in a different manner. The inverse closed-loop control structure 37BI corresponds to reversal of the closed-loop control structure 37 with the parameter set 50 for the second operational task BB. Use of the same closed-loop control structure 37 for all the operational tasks BA, BB, BC thus ensures in a simple manner that a smooth changeover takes place between the operational tasks BA, BB, BC.

Figure 8:
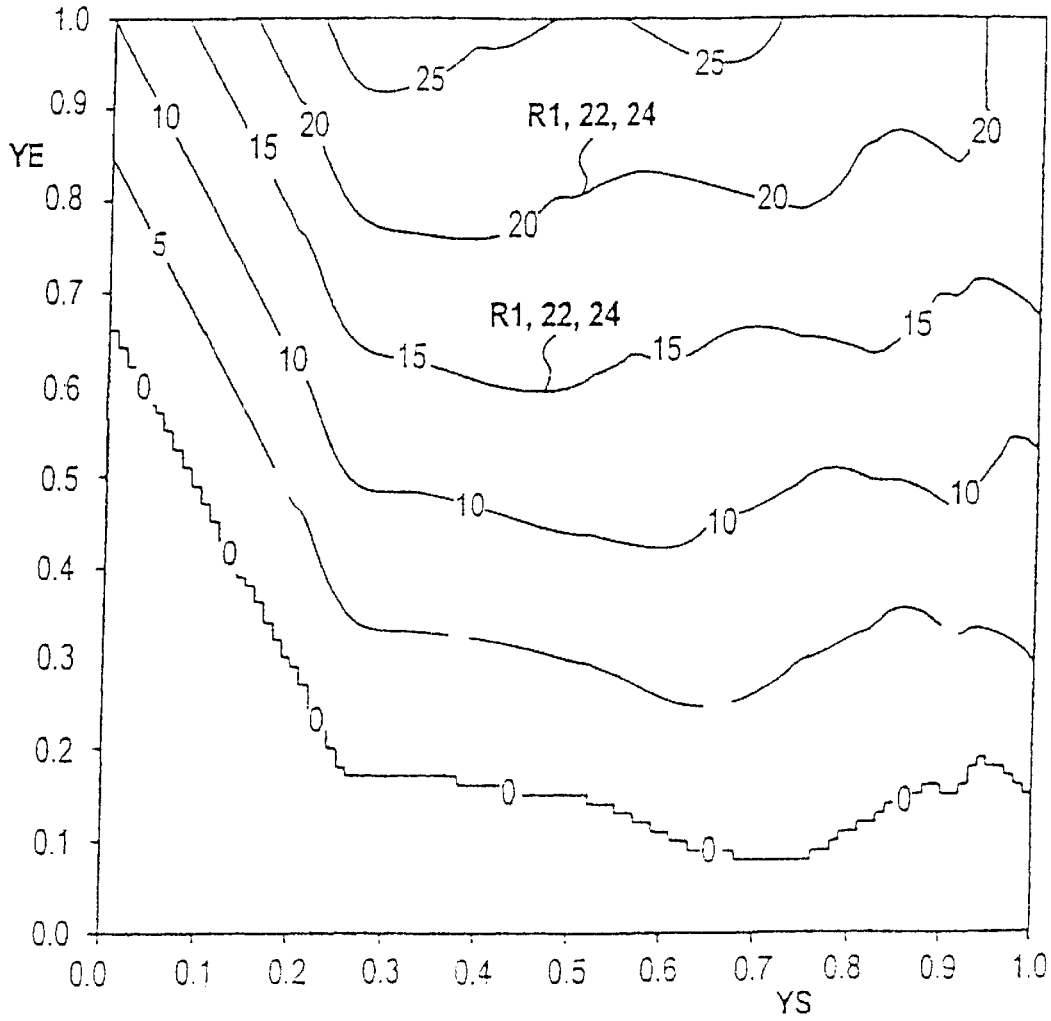
FIG 8 PRIOR ART
FIG. 8 is a coupling diagram for a bleed flow rate according to the prior art.

A further major advantage of the use of the single closed-loop control structure 37 is that the controlled variables R1, R2 are decoupled from one another over virtually the entire operating envelope. FIG. 8 shows the coupling of one of the controlled variables R1, in this case a bleed steam flow rate 22, 24, to a second controlled variable R2, in this case a power level L, according to the prior art. The lines are formed from points where the bleed steam flow rate 22, 24 is the same. The numerical values on the lines indicate the bleed steam flow rate 22, 24 in kg/s. The axes show the closed-loop control signals YE and YS associated with the controlled variables R1, R2. As can be seen, over large intervals of the operating envelope, the bleed steam flow rate 22, 24 is also highly dependent on the closed-loop control signal YS. Such strong coupling exists, in particular, in an area between zero and 25% of the values for YS.

Figure 9:
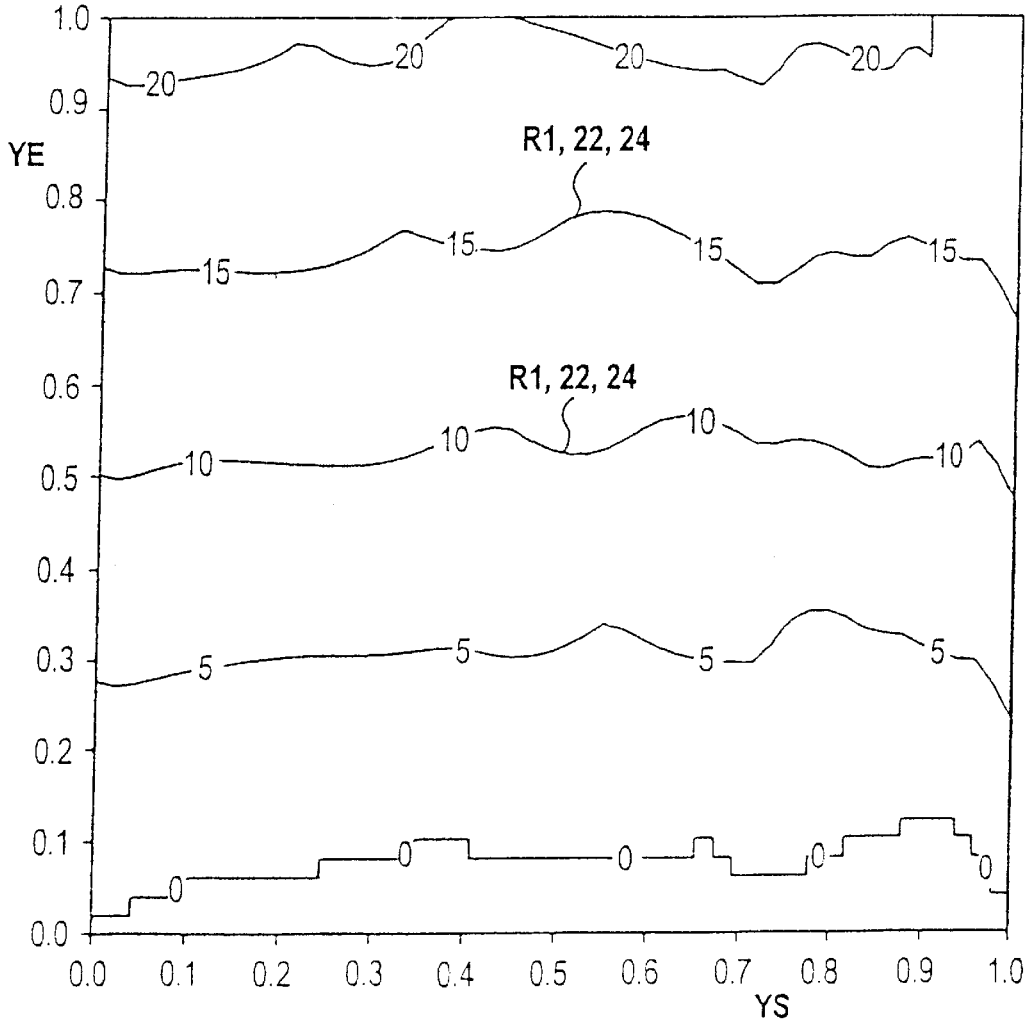
FIG. 9 is a coupling diagram for a bleed flow rate using a closed-loop control structure according to the invention that is the same for all the operational tasks.

In contrast to this, FIG. 9 shows such a coupling diagram using the closed-loop control structure 37. The bleed steam flow rate R1, 22, 24 is decoupled from the closed-loop control signal YS associated with the "power level L" controlled variable over virtually the entire operating envelope.

I claim:

1. A method for controlling a steam turbine, the method which comprises:

regulating a steam feed via a feed valve, and regulating a steam bleed via a bleed valve;

supplying, with one of a first regulator and a second regulator, a first control signal and a second control signal to a regulating structure as a function of controlled variables fed to the one of the first regulator and the second regulator;

linking, when there is a task-specific change between the first and second regulators, by using always a same regulating structure including a parameter set subdivided into subgroups, each subgroup having a first parameter and a second parameter, a result of a conversion of the first control signal with the second parameter and a result of a conversion of the second control signal with the first parameters to one another;

determining a first actuating signal with a first one of the subgroups and determining a second actuating signal with a second one of the subgroups; and feeding the first actuating signal to the feed valve and feeding the second actuating signal to the bleed valve.

2. The method according to claim 1, which comprises determining, when changing from the first regulator to the second regulator, initial variables for an output of the second regulator by using an inverse regulating structure which is an inverse of the regulating structure including the parameter set for the second regulator.

3. The method according to claim 1, which comprises determining the first actuating signal and the second actuating signal by using an offset parameter additionally assigned to each of the subgroups.

4. A control device for a steam turbine, comprising:

two regulators;

said two regulators receiving respective controlled variables and said two regulators respectively outputting, as a function of the controlled variables a first control signal and a second control signal;

a regulating structure receiving the first control signal and the second control signal, said regulating structure being a same regulating structure for said two regulators; and said regulating structure including a parameter set subdivided into subgroups, each of said subgroups having a first parameter and a second parameter, said regulating structure linking a result of a conversion of the first control signal with the second parameter and a result of a conversion of the second control signal with the first parameters to one another such that a first one of said subgroups generates a first actuating signal for a feed valve, and a second one of said subgroups generates a second actuating signal for a bleed valve.

5. The control device according to claim 4, wherein a respective one said two regulators receives, as one of the respective controlled variables, a variable selected from the group consisting of a bleed steam flow rate, a pressure in a steam for the steam turbine, a power of the steam turbine and a rotational speed of the steam turbine.

6. The control device according to claim 4, wherein said parameter set includes a feed valve subgroup and a bleed valve subgroup.

* * * * *